United States Patent [19]

Schwaner et al.

[11] Patent Number: 4,807,804

[45] Date of Patent: Feb. 28, 1989

[54] CARTON WITH LIFTING FLANGE

[75] Inventors: Jon M. Schwaner, Indianapolis, Ind.; Eric E. Falk, Louisville, Ky.

[73] Assignee: Inland Container Corporation, Indianapolis, Ind.

[21] Appl. No.: 151,415

[22] Filed: Feb. 2, 1988

[51] Int. Cl.[4] ..... B65D 5/46

[52] U.S. Cl. ..... 229/52 B; 229/171; 493/59; 493/80; 493/128

[58] Field of Search ..... 229/52 B, 171, 122; 493/59, 70, 79, 80, 128

[56] References Cited

U.S. PATENT DOCUMENTS

| | | | |
|---|---|---|---|
| 1,639,793 | 8/1927 | Beyer | 229/171 |
| 2,474,523 | 6/1949 | Guyer | 229/171 |
| 2,752,032 | 6/1956 | Fish | 229/122 |
| 3,143,272 | 8/1964 | Webb et al. | 229/52 B |
| 3,236,437 | 2/1966 | Johnson | 229/52 B |
| 3,369,652 | 2/1968 | Bebout | 229/122 |

FOREIGN PATENT DOCUMENTS

| | | | |
|---|---|---|---|
| 48454 | 3/1982 | European Pat. Off. | 229/52 B |

*Primary Examiner*—Stephen Marcus
*Assistant Examiner*—Gary E. Elkins
*Attorney, Agent, or Firm*—Fitch, Even, Tabin & Flannery

[57] ABSTRACT

Disclosed is a carton formed from a unitary paperboard blank and having a collar-like lifting flange at one end thereof for receiving a lifting blade. The carton includes a tubular body having a number of side walls formed by axially-extending fold lines. The blank from which the carton is formed includes two or more transverse extending wall portions extending across two or more side walls of the carton. The wall portions are folded upon one another and upon two or more side walls of the carton so as to continuously overlie two or more side walls of the carton and the axial fold lines joining those side walls. Thus, an unbroken corner of the lifting flange overlies an outside corner of the carton. The invention is particularly useful with lifting blades having an L-shaped cross-section which mate with an outside corner of the carton and overlie two adjacent side walls thereof. The lifting flange forms a continuous blade-receiving pocket extending across at least two laterally adjacent side walls and the fold line connecting those side walls. Accordingly, a unitary portion of the lifting flange is provided at the portion of the pocket located at the outside corner of the carton to provide a lifting flange of improved strength and tear resistance. The blank from which the carton is formed and a method of scoring and folding the blank to form the carton are also disclosed.

10 Claims, 3 Drawing Sheets

CARTON WITH LIFTING FLANGE

BACKGROUND OF THE INVENTION

1. Field of the Invention

The present invention pertains to paperboard cartons for use with mechanized material handling systems, and in particular, to such cartons having an external pocket for engagement by a lifting device.

2. Description of the Prior Art

Despite the increasingly widespread use of non-traditional packaging material, paperboard containers are oftentimes the most cost effective and easiest to handle, especially in an automated packaging environment. For example, electrical appliances and especially large consumer appliances such as refrigerators proceed down an assembly line while resting on a skid or tray-like carton portion. A collapsible, but rigid, tubular paperboard container having an open bottom end is then telescopically inserted over the appliance and its lower end is secured to the skid or tray-like member to form a completed container assembly enclosing the appliance.

With the advent of automation, many different material handling systems suitable for automated handling and inventory control have been proposed. One general type of system for handling a packaged appliance contacts the bottom end of the container and applies a lifting force thereto. The disadvantage of such systems is that lifting forks or the like must be located at or near floor level, frequently the most valuable area of a manufacturing facility. Also, lifting devices located at or near floor level pose a risk of inadvertent contact with personnel in the area of the assembly line. A second, general type of material handling system is located overhead and drops down to pick up the containers at their upper end. However, as will be readily appreciated, the top of the container is made to bear the entire weight of the appliance and its related packaging and will accordingly be placed under a significant level of stress. Although the top of the container can be reinforced with additional pieces of paperboard or plastic material components, such is generally not preferred, as the cost of packaging will be increased, and additional machinery needed to fabricate the container assembly will be required.

SUMMARY OF THE INVENTION

It is therefore an object of the present invention to provide a container which can be readily grasped at its upper end in a manner reliably supporting the weight of the packaging assembly and its contents.

Another object of the present invention is to provide a container of the above-described type formed from a unitary paperboard blank.

These and other objects of the present invention will become apparent from studying the appended description and drawings are provided in a carton formed from a unitary paperboard blank, comprised of a tubular body having an end and including first and second laterally adjacent axially-extending side panels. The side panels are joined by an axially-extending fold line, each side panel being scored with a plurality of transverse score lines, so as to form in each side panel a side wall, an end flap, and an intermediate lifting flange portion. The end flaps of the laterally adjacent side panels define an axially extending slot between the end flaps to allow independent movement of the end flaps when the end flaps are folded about a transverse score line extending between the end flaps and the intermediate lifting flange portion. The intermediate lifting flange portions together comprise a plurality of unitary axially-adjacent, transversely-extending wall portions. The wall portions are folded one on top of the other to form a collar-like lifting flange continuously overlying the side panels and the axially extending fold line joining the side panels, the lifting flange forming a continuous blade-receiving pocket with the tubular body which opens away from the end of the tubular body.

Other objects of the present invention are provided in a unitary paperboard blank adapted to be folded into a carton including a tubular body having at least one axially-extending outside corner between laterally adjacent side panels of the tubular body. The blank is comprised of a generally rectangular planar body portion having side edges extending in a first axial direction and an end edge generally transverse to the axial direction and extending between the side edges. A plurality of axially-extending fold lines in the body portion define first, second and third laterally adjacent axially-extending side panels. A plurality of generally transversely-extending score lines in the body portion adjacent the end edge thereof, extend across the first and the second laterally-adjacent side panel so as to form in the first and the second side panels a side wall, an end flap having an edge extending along the end edge, and an intermediate portion therebetween. The end flaps define an axially-extending shorter slot therebetween and axially coextensive therewith. The second and the third side panels define an axially-extending longer slot therebetween which is axially coextensive with the end flap and the intermediate portion of the second side panel, the longer slot extending from the end edge of the blank and terminating at an inner end laterally adjacent a transverse score line whereat the intermediate portion and side wall of the second side panel are joined together.

Other objects of the present invention are also provided in a method of forming a carton having a tubular body with side walls joined by an axially extending fold line at an outside corner of the carton and having a lifting flange continuously extending across the side walls and the fold line joining those side walls. The method comprises the steps of:

providing a unitary paperboard blank having first and second generally axially-extending side edges and a generally transverse end edge;

scoring the blank along a plurality of axially-extending score lines so as to form in the blank, first, second and third laterally-adjacent axially-extending side panels joined by the axially-extending score lines;

scoring the blank with a plurality of transverse score lines throughout the first and the second side panels so as to form in each the first and the second side panel, a side wall, an end flap, and an intermediate lifting flange portion;

slotting the blank so as to form an axially-extending slot between the end flaps of the first and the second side panels;

scoring the third side panel with a generally transverse score line so as to form therein an end flap generally axially coextensive with the end flap and intermediate portion of the first and the second side panels and a side wall generally coextensive with the side wall of the first and the second side panels;

slotting the blank so as to form an axially-extending longer slot between the second and the third side panels, the longer slot generally coextensive with the end flap of the third side panel and with the end flap and intermediate portion of the first and the second side panels; folding the blank along the axially-extending score lines and joining the first and the third side panels so as to form a generally tubular body; and folding the intermediate portion so as to contact the side walls of the first and the second side panels so as to form a unitary lifting flange from the intermediate portion continuously overlying the side walls of the first and the second panel portions and the fold line joining those panel portions so as to form between the lifting flange and the side walls a continuous blade-receiving pocket.

BRIEF DESCRIPTION OF THE DRAWINGS

In the drawings, wherein like elements are referenced alike.

DETAILED DESCRIPTION OF THE PREFERRED EMBODIMENT

Figure 1:
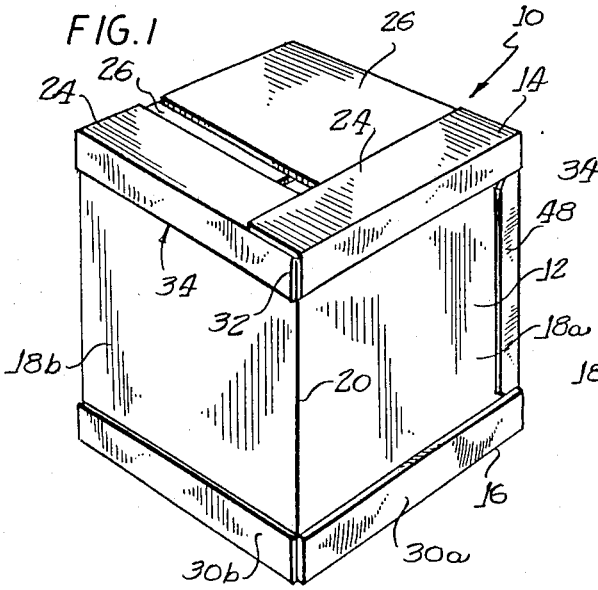
FIG. 1 is a perspective view of a carton embodying principles of the present invention, having a lifting flange extending across a prominent outside corner at the upper end the carton.

Referring now to the drawings for purposes of description, and not limitation, a fully assembled carton is illustrated in FIG. 1, constructed according to principles of the present invention. Carton 10, as will be seen, is preferably constructed from a unitary paperboard blank, and includes a tubular body 12 having an upper end 14 and a lower end 16. As illustrated, carton 10 of the preferred embodiment has four generally rectangular side walls 18*a*–18*d* joined by fold lines 20 to form outside corners of the tubular body. Fold lines 20 extend generally in the direction of the axis of the tubular body.

The upper end 14 of the tubular body 12 is preferably enclosed by four end flaps extending respectively from the four side walls of the tubular body. The end flaps include two shorter end flaps 24 and two longer end flaps 26. The lower end 16 of tubular body 12 preferably has four similarly sized bottom flaps 30*a*–30*d*. End flaps 30 are preferably folded back against their respective side walls 18 to form an open lower end 16 suitable for telescopic insertion over an article such as an electrical appliance to be received within the interior of container 10.

Referring again to FIG. 1, the corner of the upper end of the carton prominently displayed in the figure is identified by the numeral 32. The corner 32 comprises an outside corner of a lifting flange 34 which overlies the upper ends 36 of the side walls.

Figure 2:
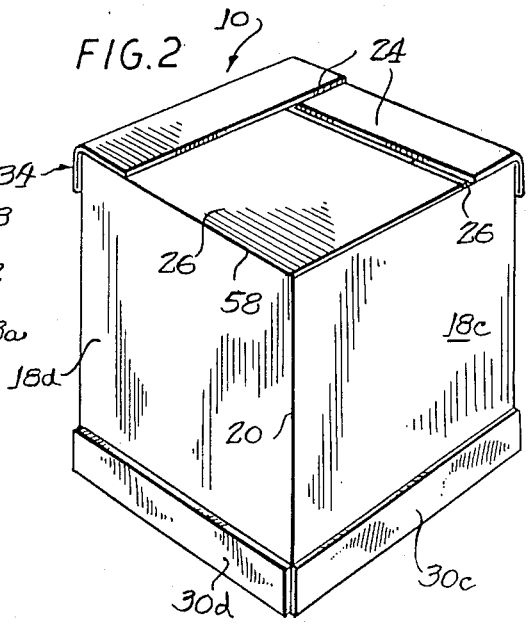
FIG. 2 is a perspective view of the carton of FIG. 1, shown rotated 180° in a horizontal plane.
Figure 3:
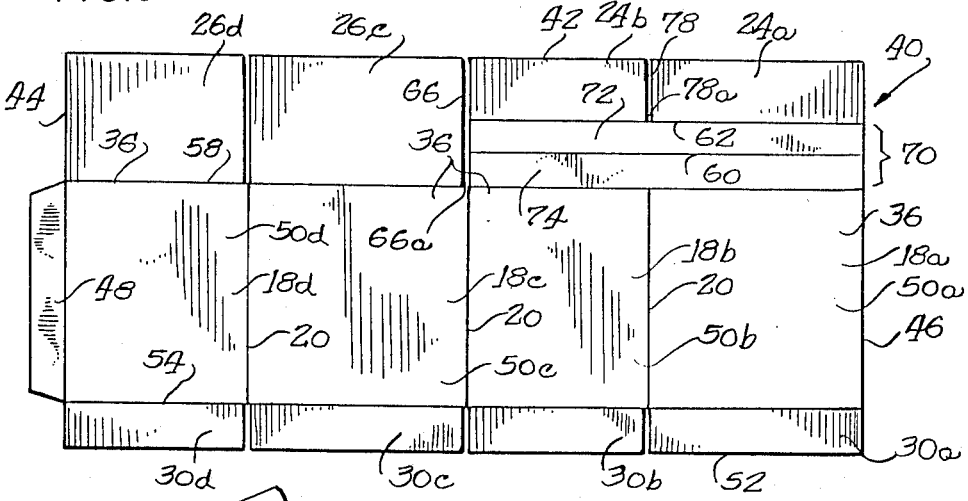
FIG. 3 shows a unitary blank from which the carton of the preceding figures is assembled.

Referring now to FIG. 3, a unitary paperboard blank 40 has a plurality of axially and transversely extending score lines formed therein. The axially-extending score lines correspond to the axial fold lines 20 illustrated in FIGS. 1 and 2. Blank 40 has a generally planar, rectangular configuration with an end edge 42 extending between side edges 44, 46. A tab 48 extends from side edge 44. Blank 40, when folded about the axially-extending fold lines 20, forms the tubular body portion 12 with side edges 44, 46 abutting each other, and tab 48 overlying and joined to the side right-hand wall 18*a*, as seen in FIG. 1.

The axial score lines 20 form a plurality of generally parallel, coextensive panel portions 50*a*–50*d*, which extend from the upper end edge 42 to a lower end edge 52 of blank 40. Each panel portion 50*a*–50*d* is generally rectangular and for the carton of the preferred embodiment, is elongated in the axial direction. As will be seen, end flaps are formed at the upper and lower ends of each panel portion by transversely-extending score lines, such as the bottom score line 54, which continuously extends across the bottom ends of the panel portions 50*a*–50*d*. The bottom score line 54 forms the bottom flaps 30*a*–30*d*, and provides fold lines for those flaps to allow the outward folding thereof illustrated in FIGS. 1 and 2.

Referring now to the upper portion of FIG. 3, a top score line 58 is continuous and extends across the upper portions of the panels 50*a*–50*d*. The score line 58 in each of the panels forms a fold line defining the upper ends of the side walls 18*a*–18*d*. The structures formed by the fold line 58 in panel portions 50*a*, 50*b*, differ from those structures formed in the remaining panel portions 50*c*, 50*d*. At the outset, it is noted that each of the structures formed by the top score line 58 extend generally equal amounts in the axial direction, that is, the distance between top score line 58 and the upper end edge 42 is generally constant, the upper end edge 42 and top score line 58 being generally parallel to each other.

Referring first to the left-hand portion of blank 40, the top score line 58 forms the larger end flaps 26 which, when folded about line 58, enclose the upper end 14 of tubular body 12. The flaps 26, as illustrated in this first embodiment, are unbroken by score lines, cuts or the like and preferably comprise continuous planar members extending between the top score line 58 and the upper end edge of blank 40. Referring to the right-hand portion of FIG. 3, two parallel, spaced-apart transverse score lines 60, 62 extend across panel portions 50*a*, 50*b*, but preferably do not extend to the end flaps 26. The score line 60 is located parallel to and intermediate the top score line 58 and the outer score line 62. An axially-extending slot 66 is formed between the top score line 58 and upper end edge 42, along the axial fold line 20, and between panel portions 50*b*, 50*c*. Score lines 60, 62 extend between the slot 66 and the side edge 46. The score lines 58, 62 form therebetween an intermediate portion 70, which extends in a generally transverse direction, between the slot 66 and the side edge 46.

Carton 10 may be formed from blank 40 in at least two different ways. In a first manner of construction, the side panels 50*a*, 50*d* can be butted together and the tab 48 affixed to the side panel 50*a* to form what is commonly termed a "manufacturer's joint," configuring the blank as a tubular body. Thereafter, the intermediate portion 70 is folded so as to form the lifting flange 34. In a second manner of forming carton 10 from blank 40, the intermediate portion 70 is folded so as to form the lifting flange prior to the joinder of panels 50*a*, 50*d* to form the manufacturer's joint.

Figure 4:
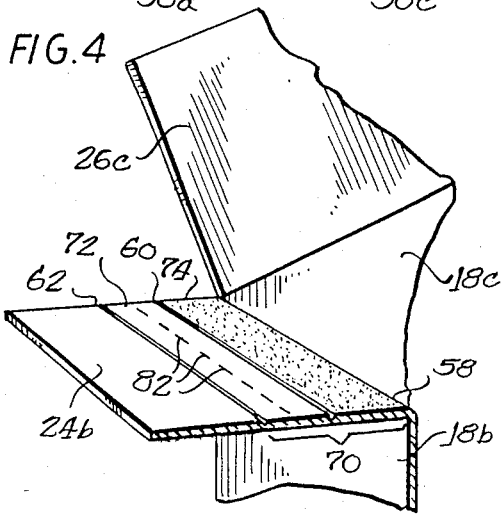
FIGS. 4–6 show three steps in assembling the lifting flange.
Figure 5:
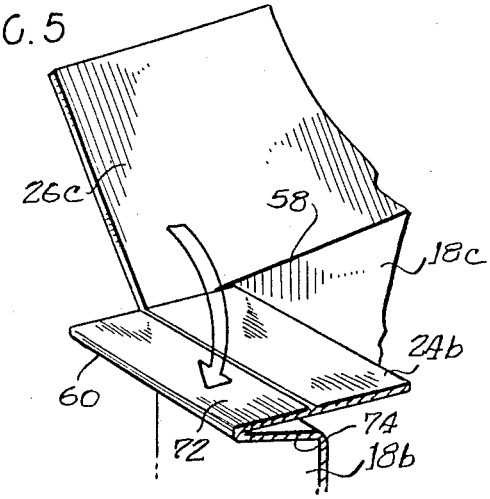
Figure 6:
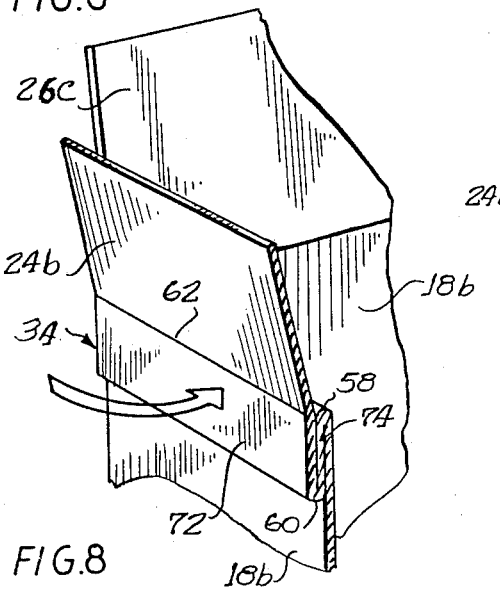

Referring now to FIGS. 4–9, construction of carton 10 from blank 40 will be described. Referring first to FIG. 4, the end flap 24 and flange-forming portions 72, 74 are folded as a unitary planar unit about the fold line 58. Next, the flange-forming portions 72, 74 are folded about score line 60 so as to bring the flange-forming portions into contact with each other, as illustrated in FIG. 5. If desired, adhesive 82 is applied to the inner surface of either of flange-forming portions 72, 74, to hold those portions together after the carton is formed and to provide surprising strength at the corners of the lifting flange 34. There are many ways of applying adhesive to the flange-forming portions. Referring to FIG. 4, the numeral 82 is directed to an adhesive stripe painted on the inside surface of flange-forming portions 72 prior to folding about score line 60.

Figure 7:
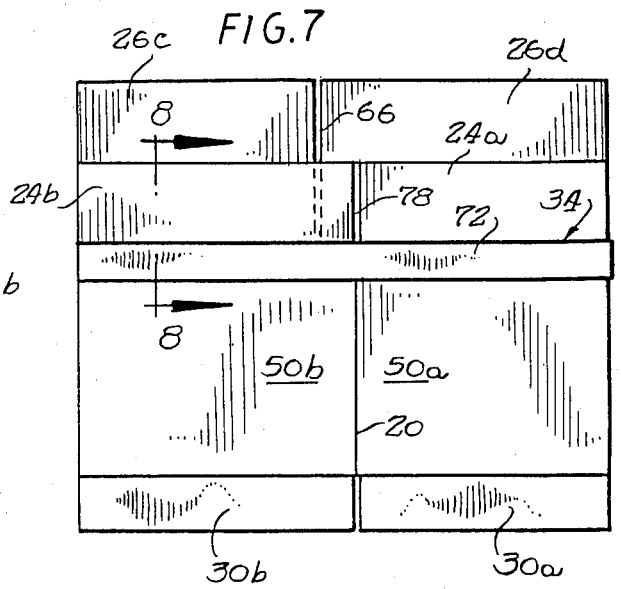
FIG. 7 shows the blank of FIG. 3 assembled end-to-end to form a tubular body and collapsed for shipment to a remote location.
Figure 8:
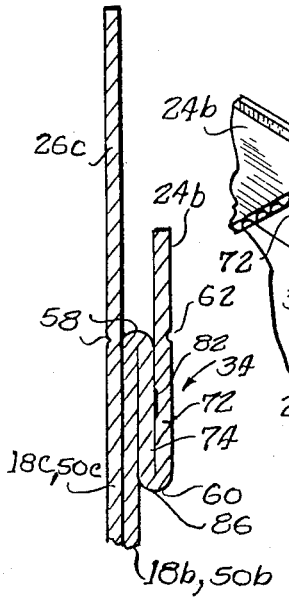
FIG. 8 is a fragmentary, cross-sectional view taken substantially along the line 8—8 of FIG. 7 and looking in the direction of the arrows.
Figure 9:
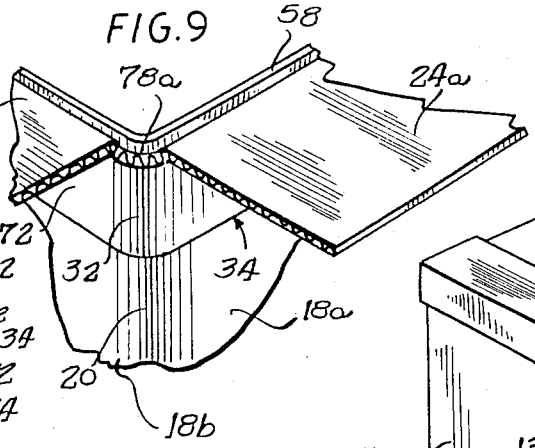
FIG. 9 is a fragmentary perspective view of the prominent upper corner of FIG. 1 shown with the end flaps of the carton in an outwardly bent position.

Next, the flange-forming portions 72, 74 are brought into contact with the side walls by folding about score line 58. This results in a reverse bend or S-shaped bend, as seen in the fragmentary view of FIG. 6 and in greater detail in FIG. 8. As shown in FIG. 8, the lower flange-forming portion 74 contacts or at least lies adjacent the side wall 18*b*, and according to a principle of the present invention is not secured thereto with adhesive. Rather, a gap or pocket 86 is formed between the lower flange-forming portion 74 and the side walls which that portion overlies. As can be seen in FIG. 8, the pocket 86 extends from the fold line 60 to the uppermost fold line 58. The flange-forming portions 72, 74 and their hinged connection to side wall 18 via the score line 58 comprises the lifting flange 34. As can be seen, the lifting flange 34 forms the pocket 86 with the side wall overlaid by the lifting flange. It is generally preferred for economic construction that the smaller end flap 24*b* be formed as an extension of the flange-forming portion 72. The score line 62 allows the end flap 24*b* to be folded to any desired position, and most importantly, the position required for the end flap to partially enclose the upper open end of the tubular body. As can be seen in FIGS. 4–9, score line 58 allows folding of the larger end flap 26*c* to also enclose the tubular body.

The end flaps 24, 26 may be folded in a variety of ways about the open end of the tubular body. The manner of folding the end flaps illustrated in FIGS. 1 and 2 is shown herein to emphasize the double reentrant or reverse bend of the intermediate portion 70 and of the resultant construction of pocket 86. However, the end flaps 24, 26 may be folded in a number of different ways. For example, the end flaps may be folded in opposed pairs, with one pair comprising the butted joinder of a smaller flap 24 with a larger flap 26. This latter folding arrangement provides a generally smooth upper surface to the container.

Referring again to FIG. 7, blank 40 is illustrated as having been joined end-to-end to form the tubular body 12, with tab 48 secured to panel portion 50 to form a manufacturer's joint. Thereafter, the tubular body is flattened or collapsed so that panels 50*a*, 50*b* are pressed against panels 50*d*, 50*c*, respectively. FIG. 7 shows a fully formed lifting flange 34. An important feature of a carton constructed according to principles of the present invention is the unitary continuous configuration of the axially-adjacent, transversely-extending flange-forming portions 72, 74 which extend across the two side panels 18*a*, 18*b*. The resulting unitary continuous nature of the flange 34 may be readily observed in FIG. 7. As will become apparent from comparing FIGS. 3 and 7, the panel portions 50*a*, 50*b* are generally coextensive with the panel portions 50*c*, 50*d*. Due to the folding of the flange-forming portions 72, 74, the panel portions 50*a*, 50*b* appear shortened in FIG. 7, so that the remaining panel portions 50*c*, 50*d* extend therebeyond. However, as can be seen in FIG. 7, the two axially-extending slots 66, 78 separating the adjacent end flaps have inner termination points laterally adjacent one another, with the slots 66, 78 terminating adjacent the upper ends of the side walls 18, when the carton is fully formed. This allows the end flaps 24, 26 to be folded about the open end of the tubular body in the desired manner.

Referring again to FIG. 3, an important feature according to the present invention is the difference in length of the slots 78 and 66. Slot 78 is the shorter of the two and is formed between the end flaps 24*a*, 24*b* extending from the upper end edge 42 of the blank to the outer score line 62. Thus, it is important to note that slot 78 has a terminus 78*a* adjacent the outer score line 62, and does not penetrate into the intermediate portion 70. Slot 66, the longer of the two slots, extends from the free end edge 42 to the top score line 58 and is formed between the end flap 26*c* of panel portion 50*c* and portions of the adjacent panel portion 50*b* which includes the smaller end flap 24*b* and the flange-forming portions 72, 74. Thus, with the flange-forming portions 72, 74 folded one upon the other and folded upon side walls 18*a*, 18*b*, the terminus 78*a* of slot 78 is located laterally opposite the terminus 66*a* of the longer slot 66.

Whether the lifting flange 34 is fully formed either before or after blank 40 is folded to form a tubular body, lifting flange 34 is, as emphasized above, unitary and continuously extends across the adjacent side walls 18*a*, 18*b* as well as the fold line joining those two side walls. In a similar fashion, the pocket 86 formed between the lifting flange and the side walls also continuously extends over the side walls 18*a*, 18*b* and the fold line 20 joining those side walls. Thus, the corner 32 of the lifting flange 34 has an improved strength due to the unitary construction of the lifting flange.

The width of slots 78, 66 is, for many applications, not critical. The apparent width of slot 78 is exaggerated in FIG. 9 for purposes of clarity.

The lifting blade contemplated by the present invention may have a number of different forms. For example, the lifting blade may have a generally flat, planar configuration adapted to engage one of the other side walls 18*a*, 18*b* and the portion of the lifting flange overlying that side wall. Preferably, however, the present invention contemplates a lifting blade generally L-shaped in cross-section, which engages not only the side walls 18*a*, 18*b* of carton 10, but also the outside corner formed at fold line 20 as well. It is important, therefore, that the lifting flange 34 have the necessary strength at its outside corner 32 to prevent a separation of the flange away from the carton side walls and to also withstand tearing under the applied force of the lifting blade, particularly at an outside corner of the lifting blade which is a point of stress concentration.

As illustrated in FIG. 3, the transverse score lines 60, 62 forming the flange-forming portions 72, 74 extend only across panel portions 50*a*, 50*b*. The preferred method of making the blank of FIG. 3 is to use rolling scoring cutters which traverse the lateral width of blank 40. Accordingly, it is generally preferred to extend the score lines 60, 62 across the panel portions 50*c*, 50*d*, as well, so that the score lines 62 extend between the edges 44, 46. The presence of the score lines 60, 62 in the flaps 26*c*, 26*d* serves no functional purpose, but is merely an expedient for employing a rolling scoring cutter to provide the desired score lines 60, 62 in the panel portions 50*a*, 50*d*. Although the end flaps 26*c*, 26*d* could be folded along the score lines formed by extending score lines 60, 62, such folding would not accomplish a useful result in most instances, the full axial extent of the end flaps 26*c*, 26*d* being needed to cover the substantial entirety of the upper open end of the tubular body 12.

As illustrated in FIGS. 1 and 2, the large and small end flaps at the upper end of the container are interfolded. If desired, the end flaps may be folded in opposed pairs, such that the upper end of the carton will be comprised of the butted joinder of a large flap 26 and a small flap 24. These flaps may also be interconnected by pinwheel-like folding. Other flap arrangements are, of course, possible and will be apparent to those skilled in the art upon studying the description and drawings. The present invention, however, is not limited by the embodiments illustrated herein, and the appended claims are intended to cover various alternative arrangements of the end flaps. According to one feature of the present invention, the lifting flange, and particularly the continuity, ease of collapsing, ease of construction and structural integrity is not affected by the manner in which the end flaps are folded. Further, it can now be seen that a carton having the improved lifting flange may be simply and economically formed from a unitary paperboard blank, such as the blank illustrated in FIG. 3, using simple scoring and folding steps. In order to maintain an optimum strength for the lifting flange, it is generally preferred that the various score lines, both axially and transversely extending, formed in the blank, not cut through the paperboard material, but rather be formed by compressing the paperboard material so as to form the fold lines as illustrated.

As mentioned briefly above, the manufacturer's joint may be located at a different outside edge of the carton. This, however, will require a reconfiguration of the blank of FIG. 3. For example, the left-hand panel portion 18*d* may be moved to the right-hand edge of panel portion 50*a*, and the tab 48 for the manufacturer's joint can be relocated to extend from the left-hand edge of panel portion 50*c*. This alternative construction of blank 40 will result in a manufacturer's joint between side walls 18*c*, 18*d*, remote from the lifting flange 34. Other locations of the manufacturer's joint and other ways of forming the tubular body portion are also contemplated by the present invention.

Referring now to FIGS. 10–13, an alternative embodiment of a carton constructed according to principles of the present invention is illustrated. The carton 100 is in many respects identical to the carton 10 described with reference to FIGS. 1–9. A first principal distinction between cartons 10 and 100 results from the lifting flange 134 of carton extending across and overlying all four side walls 118 thereof. A second difference lies in the partially enclosed upper end 114 of the carton.

Figure 10:
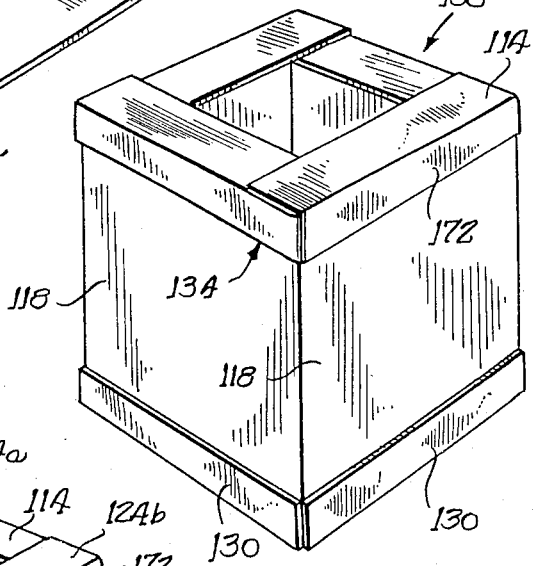
FIG. 10 is a perspective view of a carton illustrating an alternative embodiment according to the present invention, wherein a lifting flange extends over substantially the entire periphery of the upper end of the carton.
Figure 11:
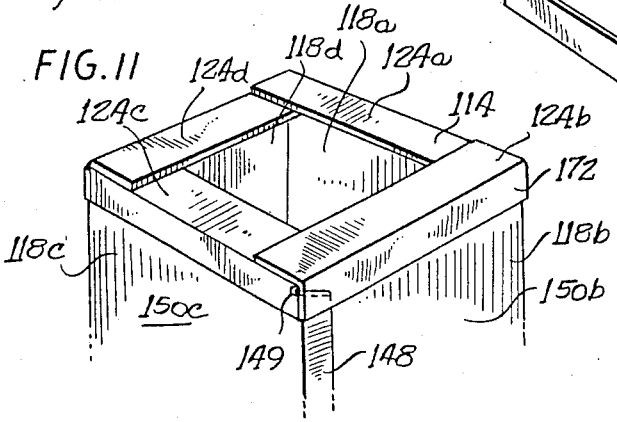
FIG. 11 is a fragmentary perspective view of the carton of FIG. 10 shown rotated 180° about a horizontal plane.

Referring now to FIGS. 10 and 11, carton 100 has four generally rectangular side walls 118 and an upper end 114 which is partially enclosed by relatively small end flaps 124. As before, the carton is also provided with bottom end flaps 130, and as illustrated, the preferred embodiment is readily adapted to telescopic insertion over an appliance or other item to be shipped within the carton.

Figure 12:
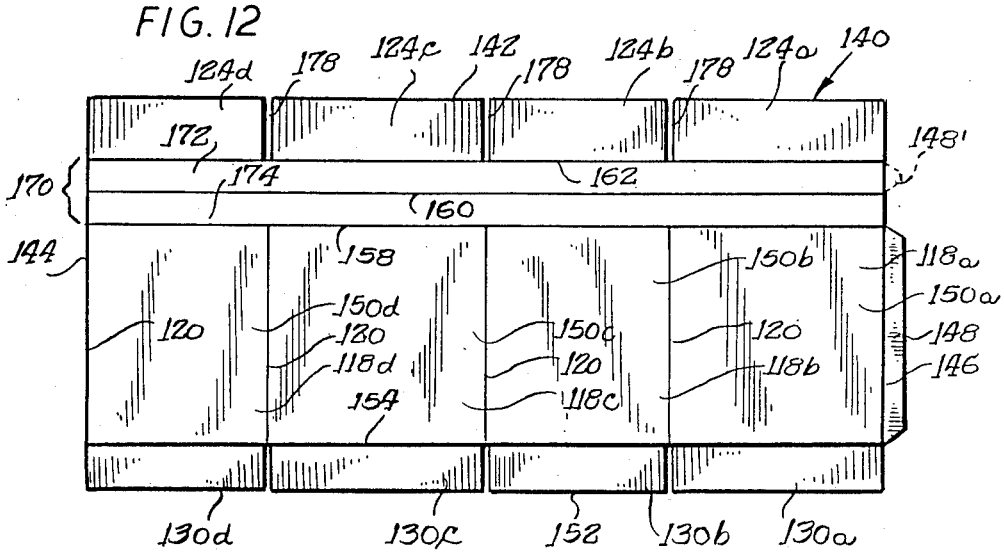
FIG. 12 shows a unitary paperboard blank from which the carton of FIGS. 10 and 11 is constructed.

Referring now to FIG. 12, the carton of FIGS. 10 and 11 is preferably formed from a unitary paperboard blank 140, having upper and lower end edges 142, 152, respectively. The blank 140 has a number of axially extending fold lines 120 formed therein which divide the blank 140 into four generally rectangular panel portions 150*a*, 150*d*. Each panel portion extends between the upper and lower end edges 142, 152. A bottom score line 154 extends continuously across all four panel portions 150*a*–150*d*. The bottom score line 154 in effect comprises a fold line forming the aforementioned bottom flaps 130, herein numbered 130*a*–130*d*, having suffixes denoting the suffixes of the panel portions 150*a*–150*d*, respectively. The bottom score line 154 is one of several score lines transversely extending between the side edges 144, 146 of carton blank 140.

A top score line 158 is formed in carton blank 140 adjacent the upper edge 142 thereof. The top score line 158 defines the upper edge of the carton side walls 118*a*–118*d*, respectively. Located above top score line 158 are an intermediate score line 160 and an outer or uppermost score line 162. The various transverse score lines 154, 158, 160, and 162 are preferably formed parallel to one another in the preferred embodiment, although other arrangements will become apparent to those skilled in the art. The aforementioned end flaps 124 are formed between the upper end edge 142 of blank 140 and the outer score 162. Unbroken unitary flange-forming portions 172, 174 are formed between the intermediate and outer score line 160, 162, and the top score line 158 and intermediate score line 160, respectively. The flange-forming portions 172, 174 are continuous and extend unbroken between the side edges 144, 146.

A series of similarly-dimensioned, generally axially-extending recesses 178 are formed between adjacent end flaps 124 and are generally aligned with the axially-extending fold lines 120. The slots 178 extend from the top end edge 142 to the outer score line 162, but do not penetrate the intermediate portion 170, herein defined as the flange-forming portions 172, 174 taken together.

Figure 13:
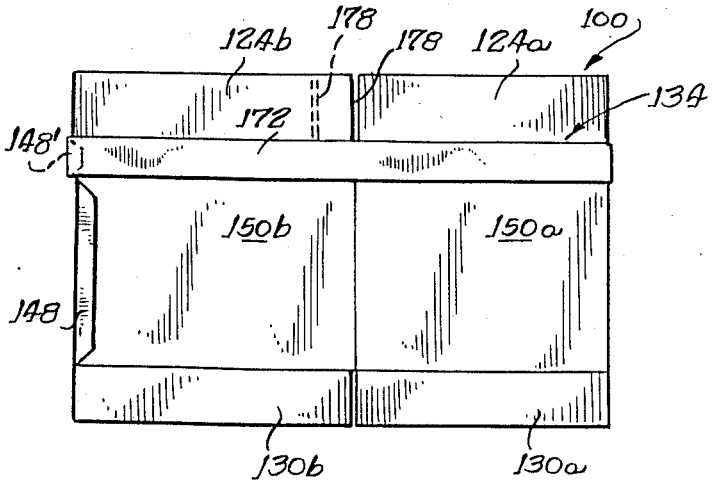
FIG. 13 shows the paperboard blank of FIG. 12 joined end-to-end to form a generally tubular configuration and collapsed for shipment to a remote location.

Referring now to FIG. 13, the panel portions 150*a*, 150*d* are butted together and tab 148 is secured to the free edge of panel portion 150*a* to form a manufacturer's joint, similar to that illustrated in FIG. 1. Thereafter, the flange-forming portion 174 is folded about the top score line 158 so as to come into contact with the side walls 118*a*–118*d*. The upper flange-forming portion 172 is then folded about score line 160 so as to come into contact with the other flange-forming portion 174, to complete the same double reentrant, reversely bent, or S-shaped construction described above with reference to FIGS. 6 and 8. Adhesive is applied between the opposing faces of flange-forming portions 172, 174 in the manner described above with reference to FIG. 8. The resulting lifting flange 134 is substantially identical to the lifting flange 34 of the preceding embodiment, except that the lifting flange 134 of FIGS. 10–13 is continuous across all side walls and all but one outside corner of the carton. Accordingly, it is necessary to fold the flange-forming portions 172, 174 prior to forming the manufacturer's joint so as to complete the tubular body. After the folding of flange-forming portions 172, 174 is completed in a manner similar to that indicated above with reference to FIGS. 4–9, so as to fully fabricate the lifting flange 134, the free edges of panel portions 150*a*, 150*d* can be butted together, and the manufacturer's joint completed with the adhesion of tab 148 to the free edge of panel portion 150*a*, as illustrated in FIGS. 11 and 13. As illustrated in FIG. 11, a gap 149 will be formed in the lifting flange, at one outside corner of the carton, between the free edges of the upper flange-forming portion 172.

If desired, an optional tab 149', indicated in phantom at the right-hand end of FIG. 12, can be employed to form a unitary lifting flange which extends continuously around the periphery of carton 100, and has unbroken portions overlying each outside corner of the carton. The flange 148', as illustrated in phantom in the left-hand portion of FIG. 13, overlies and preferably is adhesively joined to the free end portion of the flange-forming portion 172. In this manner a continuous lifting flange is provided at the outside corner joining side walls 118*b*, 188*c*.

With this arrangement, a lifting blade can be applied at any outside corner of carton 100 and find optimum strength thereat so as to resist tearing, or separation or lifting of the lifting flange away from the carton side wall, which might permit the lifting blade to disengage from the carton.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A carton formed from a unitary paperboard blank, comprising:

a tubular body having an end and including first and second laterally adjacent axially-extending side panels joined by an axially-extending fold line, each side panel scored with a plurality of transverse score lines so as to form in each side panel a side wall, an end flap, and an intermediate lifting flange portion, said end flaps of said laterally adjacent side panels defining an axially extending slot between said end flaps to allow independent movement of said end flaps when said end flaps are folded about one of said transverse score lines extending between said end flaps and said intermediate lifting flange portion; and said intermediate lifting flange portions together comprising a plurality of unitary axially adjacent transversely extending wall portions folded one on top of the other and bonded together with adhesive means to form a collar-like lifting flange continuously overlying said side panels and the axially extending fold line joining said side panels, said lifting flange forming a continuous blade-receiving pocket with said tubular body which opens away from the end of said tubular body.

2. The carton of claim 1 wherein said tubular body further comprises a third axially extending side panel laterally adjacent and generally coextensive with said first and said second side panels, said plurality of transverse fold lines extending across said first and said second side panels.

3. The carton of claim 2 wherein said third side panel is scored with said plurality of transverse score lines, said end flaps and said intermediate portions of said third side panel together comprising generally planar end walls.

4. The carton of claim 2 wherein said third side panel is scored to form an end flap and said first and said third side panels form an axially extending slot therebetween which is generally coextensive with both the end flap of said third side panel and the end flap and intermediate lifting flange portion of said first side panel, the slot between said first and said third side panels being substantially longer than the slot between the end flaps of said first and second side panels.

5. The carton of claim 2 wherein said third side panel is scored with a generally transverse score line so as to form therein a side wall generally coextensive with the side walls of said first and said second side panels and an end flap generally coextensive with the end flap and the intermediate lifting flange portion of said first and said second side panels.

6. The carton of claim 4 wherein said tubular body comprises a fourth axially extending side panel laterally adjacent said third side panel and joined thereto by another axially-extending fold line, said third and fourth side panels laterally adjacent said second side panel and scored with extensions of said plurality of transverse lines so as to form, in said fourth side panel, a side wall and an end flap, said end flaps of said third and fourth side panels generally coextensive with both the end flaps and the intermediate flange-forming portions of said first and said second side panels, said third and said fourth side panels defining an axially-extending slot therebetween generally coextensive with the end flaps thereof, and said second and said third side panels defining a continuous axially-extending slot therebetween generally coextensive with the end flap of said third side panel.

7. A unitary paperboard blank adapted to be folded into a carton including a tubular body having at least one axially-extending outside corner between laterally adjacent side panels of the tubular body, comprising:

a generally rectangular planar body portion having side edges extending in a first axial direction and an end edge generally transverse to said axial direction and extending between said side edges;

a plurality of axially-extending fold lines in said body portion defining first, second and third laterally adjacent axially-extending side panels;

a plurality of generally transversely-extending score lines in said body portion adjacent said end edge thereof, said score lines extending across said first and said second laterally-adjacent side panels so as to form in said first and said second side panels a side wall, an end flap having an edge extending along said end edge, and an intermediate portion therebetween with adhesive means on said intermediate portion;

said end flaps defining an axially-extending shorter slot therebetween and axially coextensive therewith; and said second and said third side panels defining an axially-extending longer slot therebetween which is axially coextensive with the end flap and the intermediate portion of said second side panel, said longer slot extending from the end edge of said blank and terminating at an inner end laterally adjacent a transverse score line whereat the intermediate portion and side wall of said second side panel are joined together.

8. The blank of claim 7 wherein said third side panel is scored with score lines extending from said pair of transversely-extending score lines so as to form in said third side panel a side wall coextensive with the side walls of said first and said second side panels and a scored end flap generally coextensive with the end flap and the intermediate portion of said first and said second side panels, whereby the transverse score lines in said unitary paperboard blank can be formed throughout the transverse extent of said blank in a continuous scoring operation.

9. A method of forming a carton having a tubular body with side walls joined by an axially extending fold line at an outside corner of the carton and having a lifting flange continuously extending across the side walls and the fold line joining those side walls, comprising the steps of:

providing a unitary paperboard blank having first and second generally axially-extending side edges and a generally transverse end edge;

scoring the blank along a plurality of axially-extending score lines so as to form in the blank, first, second and third laterally-adjacent axially-extending side panels joined by the axially-extending score lines;

scoring said blank with a plurality of transverse score lines throughout said first and said second side panels so as to form in each said first and said second side panel, a side wall, an end flap, and a multi-section intermediate lifting flange portion;

slotting said blank so as to form an axially-extending slot between the end flaps of said first and said second side panels;

scoring said third side panel with a generally transverse score line so as to form therein an end flap generally axially coextensive with the end flap and intermediate portion of said first and said second side panels and a side wall generally coextensive with the side wall of said first and said second side panels;

slotting said blank so as to form an axially-extending longer slot between said second and said third side panels, said longer slot generally coextensive with the end flap of said third side panel and with the end flap and intermediate portion of said first and said second side panels;

folding said blank along said axially-extending score lines and joining said first and said third side panels so as to form a generally tubular body;

applying adhesive to at least one section of said multi-section intermediate portion; and folding said intermediate portion so as to bond the sections of said multi-section intermediate portion and to overlie said side walls of said first and said second side panels and the folded score line joining those panels with said folded multi-section intermediate portion, so as to form a unitary lifting flange from said intermediate portion which continuously overlies the side walls of said first and said second panel portions and the score line joining those panel portions so as to form between said lifting flange and said side walls a continuous blade-receiving pocket.

10. The method of claim 9 wherein said step of folding said intermediate portion to form said lifting flange is performed before the step of joining said first and said third side panel portions together so as to form said tubular body.

* * * * *

UNITED STATES PATENT AND TRADEMARK OFFICE

CERTIFICATE OF CORRECTION

PATENT NO. : 4,807,804

DATED : February 28, 1989

INVENTOR(S) : Jon M. Schwaner et al.

It is certified that error appears in the above-identified patent and that said Letters Patent is hereby corrected as shown below:

Column 1, line 12, change "material" to --materials--.

Column 2, line 26, change "panel" to --panels--.

Claim 6, column 10, line 40, after "transverse" insert --score--.

Signed and Sealed this

Nineteenth Day of September, 1989

*Attest:*

*Attesting Officer*

DONALD J. QUIGG

*Commissioner of Patents and Trademarks*